US009537241B2

(12) United States Patent
Rivera et al.

(10) Patent No.: US 9,537,241 B2
(45) Date of Patent: Jan. 3, 2017

(54) ELECTRICAL CONNECTOR WITH FEMALE TERMINAL AND MOTOR WITH SUCH AN ELECTRICAL CONNECTOR

(71) Applicant: NIDEC MOTORS & ACTUATORS (Germany) GmbH, Bietigheim-Bissingen (DE)

(72) Inventors: Ruben Rivera, El Paso, TX (US); Robert Scott Myerly, El Paso, TX (US)

(73) Assignee: NIDEC MOTORS & ACTUATORS (Germany) GmbH, Bietigheim-Bisingen (DE)

( * ) Notice: Subject to any disclaimer, the term of this patent is extended or adjusted under 35 U.S.C. 154(b) by 0 days.

(21) Appl. No.: 14/689,299

(22) Filed: Apr. 17, 2015

(65) Prior Publication Data

US 2015/0303604 A1 Oct. 22, 2015

(30) Foreign Application Priority Data

Apr. 17, 2014 (LU) ..... 92431

(51) Int. Cl.
*H01R 13/64* (2006.01)
*H01R 13/11* (2006.01)
*H01R 13/631* (2006.01)

(52) U.S. Cl.
CPC ..... *H01R 13/113* (2013.01); *H01R 13/6315* (2013.01)

(58) Field of Classification Search
CPC .... H01R 13/113; H01R 13/11; H01R 13/6315
USPC ..... 439/246, 850
See application file for complete search history.

(56) References Cited

U.S. PATENT DOCUMENTS

| | | | |
|---|---|---|---|
| 6,109,981 | A | 8/2000 | Jin-ichi et al. |
| 2004/0077231 | A1 | 4/2004 | Harada et al. |
| 2012/0129407 | A1 | 5/2012 | Glick et al. |

FOREIGN PATENT DOCUMENTS

| | | | |
|---|---|---|---|
| GB | 1497128 | A | 1/1978 |
| GB | 2404794 | A | 2/2005 |

*Primary Examiner* — Khiem Nguyen
(74) *Attorney, Agent, or Firm* — 24IP Law Group; Timothy R DeWitt

(57) ABSTRACT

The invention relates to an electrical connector comprising, a female terminal, including a terminal base body; one or more pairs of terminal plates facing each other, protruding in an insertion direction from the edge of the terminal base body, for receiving and connecting to a mating male terminal and the one or more pairs of terminal plates facing each other being adapted to form recesses for receiving the mating male terminal and to provide a clamping compressive force against the mating male terminal; and one or more tilting restriction elements, a connector cavity for building the female terminal in, and an opening of the electrical connector for inserting a mating male terminal for connecting the mating male terminal with the female terminal, wherein the connector cavity includes one or more contacting portions corresponding to the tilting restriction elements.

9 Claims, 2 Drawing Sheets

ELECTRICAL CONNECTOR WITH FEMALE TERMINAL AND MOTOR WITH SUCH AN ELECTRICAL CONNECTOR

BACKGROUND OF THE INVENTION

Technical Field of the Invention

The invention relates to an electrical connector with the female terminal movable inside the electrical connector cavity and a motor with such an electrical connector.

Brief Description of the Related Art

Electrical connectors have been developed for the motor industry. In the motor industry an electrical connector that comprises a female terminal inside a connector housing is used. Such a connector housing is sometimes integrally formed with a motor cover or a brush holder plate and therefore a female terminal is built into the connector housing portion of a motor cover or a brush holder plate. Terminals may be made from conductive metal, such as copper. Technical norms require that the female connector should be able to move inside the electrical connector cavity in all directions, to allow the expansion of the female terminal, particularly because the female terminal spreads out when the female terminal receives the mating male terminal or because the female terminal is swollen when temperature increases. This ensures, in turn, less friction oxidation on the point where the female terminal contacts the electrical connector cavity.

The patent publication U.S. Patent Application Publication No. 2012/0129407 describes an electrical connector for connecting to a male blade terminal. The electrical connector comprises a female terminal including one or more pairs of opposing beams for compressing against the male blade terminal. Clamping means are provided. However this patent publication does not disclose any feature that the female terminal inside the electrical connector cavity does not always contact any part of the side wall of the electrical connector cavity and therefore the female connector is movable inside the electrical connector cavity. Such a feature can avoid friction oxidation of the female terminal especially when the mating male terminal is inserted into the female terminal.

In case the electrical connector cavity is large but the terminal is too small, the female terminal is movable inside the electrical connector cavity and tilts inside the electrical connector cavity and can avoid friction oxidation of the female terminal when the mating male terminal is inserted into the female terminal. However due to too much space in the electrical connector cavity, the female terminal can be misaligned from the opening of the electrical connector where the mating male terminal is inserted into. The terminals can be damaged when the mating terminal is inserted.

One solution is making the electrical connector cavity smaller in order to reduce the female terminal movement. However, the smaller electrical connector cavity creates an interference condition when the mating male terminal is inserted into the female terminal, and the female terminal expands outward, and the expanded female terminal prevents the female terminal from moving inside the electrical connector cavity. This increases the risk of friction oxidation.

An object of the present invention is to provide an improved electrical connector with a female terminal which can keep the female terminal movable inside an electrical connector cavity.

Another object of the present invention is to provide an electrical connector with a female terminal which has durability against the pressure at the time of insertion of the mating male terminal into the female terminal.

Still another object of the present invention is to provide for an electrical motor having such an electrical connector with a female terminal.

SUMMARY OF THE INVENTION

For this effect, the present invention proposes an electrical connector comprising, a female terminal, including a terminal base body; one or more pairs of terminal plates facing each other, protruding in an insertion direction from the edge of the terminal base body, for receiving and connecting to a mating male terminal and the one or more pairs of terminal plates facing each other being adapted to form recesses for receiving the mating male terminal and to provide a clamping compressive force against the mating male terminal; and one or more tilting restriction elements, a connector cavity for building the female terminal in, and an opening of the electrical connector for inserting a mating male terminal for connecting the mating male terminal with the female terminal, wherein the connector cavity has one or more contacting portions corresponding to the tilting restriction elements and contacting to the tilting restriction elements when the female terminal tilts inside the electrical connector cavity.

By providing one or more tilting restriction elements, the female terminal can be prevented from misalignment, while keeping the female terminal movable inside the electrical connector cavity.

Preferably, the one or more pairs of the terminal plates facing each other comprise two pairs of the terminal plates facing each other.

In another embodiment, the one or more pairs of the terminal plates facing each other have terminal ends at their ends opposite to the terminal base body, wherein the gap between the terminal plates facing each other becomes bigger moving from the point that receives the mating male terminal towards the terminal ends so that a part of the terminal end remains invisible in view from the opening when the tilting restriction elements contact either contacting portion. With such an arrangement, in view from the opening there is no gap between the female terminal and the connector opening which opens for the mating male terminal being inserted, so that the mating male terminal is smoothly inserted into the female terminal through being guided by the terminal plate.

In one embodiment, the tilting restriction element comprises at least one tilting restriction member, protruding in the insertion direction from the edge of terminal base body and being arranged to be parallel to the direction that the pair of terminal plates is facing each other. Preferably, the tilting restriction element comprises two tilting restriction members, protruding in the insertion direction from the edge of the terminal base body, and the two tilting restriction members being laterally provided. By providing one or two protruding members, the tilting angle of the female terminal can be controlled. The tilting restriction element can comprise at least one tilting restriction member, expanding outwardly from the edge of the terminal base body.

In one embodiment, the at least one tilting restriction member is substantially T-shaped, with a first width in the direction in which the terminal plates can deform or face each other at the terminal base body side and a second width at the side the mating male terminal is inserted, the second width being larger than the first width. A T-shaped tilting restriction member has therefore a main body, protruding in the insertion direction from the edge of the terminal base side, with two lateral lobes or elements, which allows tilting control, especially in the wide connector cavity.

Preferably, the second width is less or equal to a width of the terminal base body. The width of the connector cavity is larger than the entire tilting restriction member. In this case, the tilting restriction member allows the maximum tilt angle.

In one embodiment, the at least one tilting restriction member is substantially I-shaped, with a rounded top. In such an embodiment a contacting portion comprises preferably a projected portion from the electrical connector cavity towards the tilting restriction members of the female terminal.

In one aspect of the invention the electrical connector comprises a pair of contacting portions for each tilting restriction forming a slot being less wide than the connector cavity at the terminal plates. The contacting portions may comprise four projected portions from the electrical connector cavity towards the tilting restriction members of the female terminal, two of which face each other across one of the tilting restriction members.

Preferably, the at least one tilting restriction member is shorter than the terminal plates. This arrangement allows the female terminal movable in the insertion direction. In such a configuration it is possible to arrange the tilting-restriction member in such a manner that during insertion of the male connector any interference except for the terminal plates can be avoided. In particular the tilting restriction member can be arranged below an optional top portion protruding inwardly from the connector cavity at the opening for inserting the mating male terminal, thus forming an edge of the opening, hiding the tilting-restriction member The present invention furthermore proposes a motor comprising an electrical connector as described above. And in case of the motor, the electrical connector may be integrally formed with a motor cover or a brush holder plate and therefore the female terminal is built into the connector portion of the motor cover or the brush holder plate. The electrical connector can also be arranged separately from the motor cover or the brush holder plate.

Still other aspects, features, and advantages of the present invention are readily apparent from the following detailed description, simply by illustrating a preferable embodiments and implementations. The present invention is also capable of other and different embodiments and its several details can be modified in various obvious respects, all without departing from the spirit and scope of the present invention. Accordingly, the drawings and descriptions are to be regarded as illustrative in nature, and not as restrictive. Additional objects and advantages of the invention will be set forth in part in the description which follows and in part will be obvious from the description, or may be learned by practice of the invention.

BRIEF DESCRIPTION OF THE DRAWINGS

For a more complete understanding of the present invention and the advantages thereof, reference is now made to the following description and the accompanying drawings, in which.

DETAILED DESCRIPTION OF THE INVENTION

The invention will now be described on the basis of the drawings. It will be understood that the embodiments and aspects of the invention described herein are only examples and do not limit the protective scope of the claims in any way. The invention is defined by the claims and their equivalents. It will be understood that features of one aspect or embodiment of the invention can be combined with a feature of a different aspect or aspects and/or embodiments of the invention.

Figure 1:
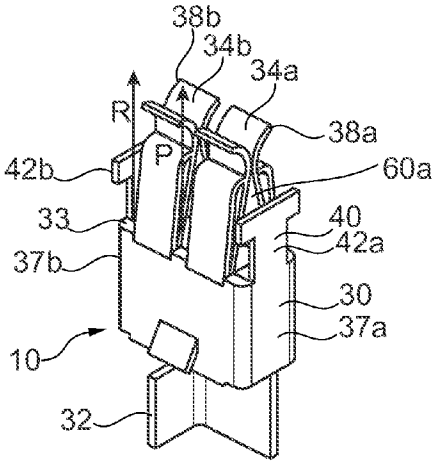
FIG. 1 shows a first aspect of a female terminal for an electrical connector according to a first embodiment of the present disclosure.
Figure 2:
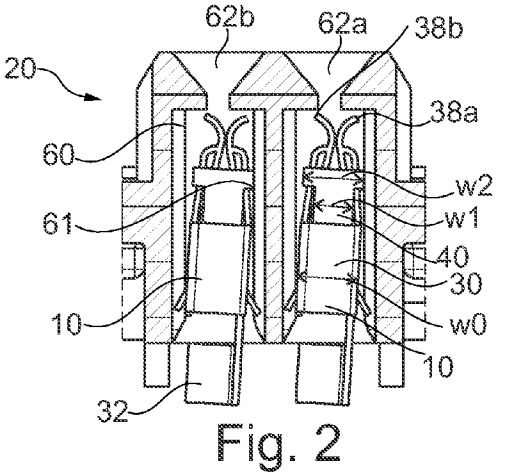
FIG. 2 shows an electrical connector in a first aspect according to an embodiment of the present disclosure

FIG. 1 shows a first aspect of a female terminal 10 for an electrical connector 20 according to a first embodiment of the present disclosure and the electrical connector 20 comprising the female terminal 10 in the first aspect according to an embodiment of the present disclosure being shown on the schematic view of FIG. 2.

The female terminal 10 comprises a terminal base body 30 formed with a termination area 32 at one end for connecting to another electrical connector or wire. Two pairs of the terminal plates facing each other 34*a*, 34*b* are protruding from an end surface 33 at the other end of the terminal base body 30, in an insertion direction R, for connecting to a mating male terminal, preferably flat male terminal plate, such as a male terminal in a power supply box in a vehicle.

Each of the two pairs of the terminal plates facing each other 34*a*, 34*b* is adapted to form a recess 60*a* for receiving the mating male terminal and to provide a clamping compressive force against the mating male terminal. The pairs of the terminal plates facing each other 34*a*, 34*b* protrude in the insertion direction R, which is perpendicular to the end surface 33 of at the end of the terminal base body 30. The pairs of the terminal plates facing each other 34*a*, 34*b* have a terminal end 38*a*, 38*b* at their end opposite to the terminal base body 30.

As can be seen on FIG. 2, the female terminal 10 can be built in and arranged inside an electrical connector cavity 60 of the electrical connector 20. The electrical connector cavity 60 houses two female terminals 10 on FIG. 2. The electrical connector cavity 60 is provided with an opening 62*a*, 62*b* for inserting a mating male terminal for connecting the mating male terminal with the female terminal.

The female terminal 10 can move inside the electrical connector cavity 60. The female terminal 10 comprises a tilting restriction element 40, adapted to restrict a tilting movement of the female terminal by contacting a contacting portion 61 of the electrical connector cavity.

The tilting restriction element 40 in the first aspect of the present disclosure comprises two tilting restriction members 42*a*, 42*b*, protruding from the terminal base body 30, in the insertion direction R and being arranged to be parallel to the direction that the pair of the terminal plates are facing each other. The two tilting restriction members 42*a*, 42*b* are laterally provided, on each lateral end side 37*a*, 37*b* of the main terminal body 30.

The person skilled in the art will understand that the tilting restriction element 40 may comprise only one tilting restriction member 42*a*, 42*b* provided at one end side of the main terminal body 30. Similarly, one or two tilting restriction members 42*a*, 42*b* could be provided on any one of the two lateral end of the main terminal body 30.

The person skilled in the art will also understand that the tilting restriction member 42*a*, 42*b* is shown as protruding in the insertion direction R. The tilting restriction member 42*a*, 42*b* may expand outwardly.

The tilting restriction members 42*a*, 42*b* are substantially T-shaped, with a first width W1 at the terminal base side and a second width W2 at the side the mating male is inserted. The second width W2 is larger than the first width W1. And the second width W2 is shorter than the width of the terminal base side W0. Such arrangement proposes the maximum tilting angle.

The tilting restriction member 42*a*, 42*b* are shorter than the pairs of the terminal plates facing each other 34*a*, 34*b*.

As can be seen in FIG. 2, this arrangement of the tilting restrictions members 42*a*, 42*b* are arranged to dispose a part of the terminal end 38*a*, 38*b* of the pairs of the terminal plates facing each other 34*a*, 34*b* to remain invisible in view from the opening 62*a*, 62*b* when the tilting restriction members 42*a*, 42*b* contact either contacting portion 61.

Figure 3:
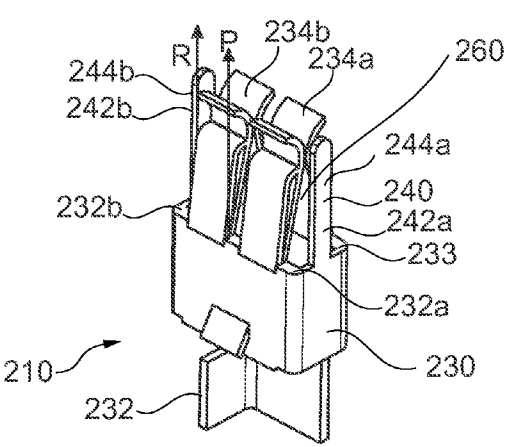
FIG. 3 shows a further aspect of a female terminal for an electrical connector according to a second embodiment of the present disclosure.
Figure 4:
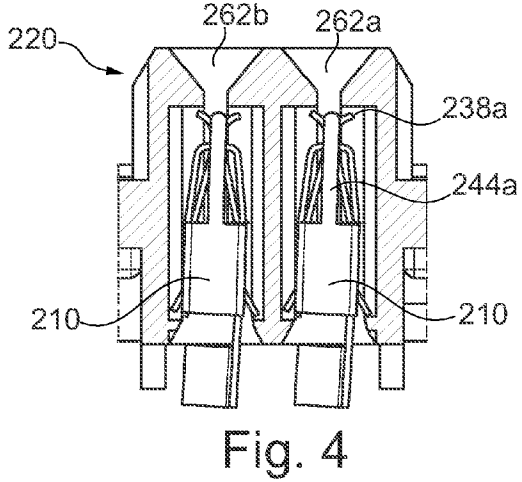
FIG. 4 shows an electrical connector in a further aspect according to the present disclosure.

FIG. 3 shows a first aspect of a female terminal 210 for an electrical connector 220, the electrical connector 220 being shown in FIG. 4 with the female terminal 210.

The female terminal 210 comprises a terminal base body 230 formed with a termination area 232 at one end for connecting to another electrical connector or wire. Two pairs of the terminal plates facing each other 234*a*, 234*b* are protruding from an end surface 233 at the other end of the terminal base body 230, in an insertion direction R, for connecting to a mating male terminal, preferably flat male terminal blade, such as a male terminal blade in a power distribution box in a vehicle.

Each of the two pairs of the terminal plates facing each other 234*a*, 234*b* is adapted to form a recess 260*a* for receiving the mating male terminal and to provide a clamping compressive force against the mating male terminal. The pairs of the terminal plates facing each other protrude in the insertion direction R, which is perpendicular to the end surface 233 of at the end of the terminal base body 230. The pairs of the terminal plates facing each other 234*a*, 234*b* have terminal ends 238*a*, 238*b* at their end opposite to the base body 230.

The female terminal 210 comprises a tilting restriction element 240, adapted to restrict a tilting movement of the female terminal when the female terminal is in operative position within the electrical connector cavity by contacting a contacting portion 261 of the electrical connector cavity.

Figure 5:
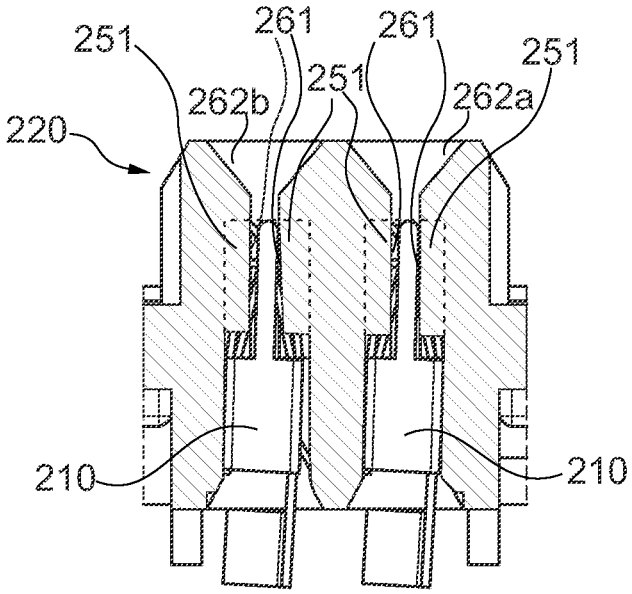
FIG. 5 shows an electrical connector in a further aspect according to the present disclosure in a sectional view taken along a plane parallel and adjacent to a tilting restriction member.

As shown in FIG. 5, the contacting portion 261 comprises projected portions 251 from the electrical connector cavity 60 towards the tilting restriction members 240 of the female terminal 210. The projected portions being provided to project in the direction in which the terminal plates can deform and in a direction transverse thereto.

The tilting restriction element 240 in the second aspect of the present disclosure comprises two tilting restriction members 242*a*, 242*b*, protruding from the terminal base body 230, in the insertion direction R and being arranged to be parallel to the direction that the pair of the terminal plates are facing each other. The two tilting restriction members 242*a*, 242*b* are laterally provided, on each lateral end side 232*a*, 232*b* of the main terminal body 230.

The person skilled in the art will understand that the tilting restriction element may comprise only one tilting restriction member provided at one end side of the main terminal body. Similarly, one or two tilting restriction members 242*a*, 242*b* could be provided on any one of the four lateral end of the main terminal body 230.

The person skilled in the art will understand that the tilting restriction member 242*a*, 242*b* is shown as protruding in the insertion direction R. The tilting restriction member 242*a*, 242*b* may expand outwardly.

As can be seen on FIG. 4 showing the electrical connector 220 with the female terminal 210, the female terminal 210 can be arranged within an electrical connector cavity 260 of the electrical connector 220. The connector cavity 260 houses two female terminals 210 on FIG. 4. The connector cavity 260 is provided with an opening 262*a*, 262*b* for inserting a mating male terminal for connection of the mating male terminal with the female terminal. The connector cavity 260 in this aspect of the disclosure is smaller and is in both the direction of deformation of the terminal plate and transverse thereto not as wide as the connector cavity 60 of FIG. 2.

The tilting restriction members 242*a*, 242*b* in this aspect of the disclosure comprises an elongated restriction body 244*a*, 244*b*, in an elongated rectangular form, having preferably a rounded end portion providing for a smooth surface upon contacting the contacting portion. The tilting restrictions members 242*a*, 242*b* are well adapted for a smaller cavity slot in a connector, the slot being confined by the projected portions 251 defining on either side of the contacting portions 261.

Figure 5A:
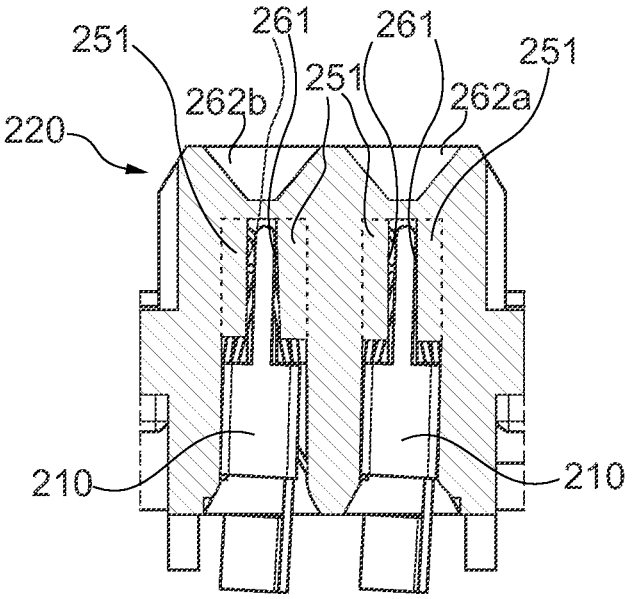
FIG. 5A shows an electrical connector in a further aspect according to the present disclosure in a view similar to the one of FIG. 5.

The slot can be open at the top as illustrated in FIG. 5 or may be closed by an edge of the opening intended for inserting the male connector as it is illustrated in FIG. 5A. When the slot is closed at the top the risk of inadvertently biasing the tilting restriction element can be reduced upon inserting the male terminal. On the other hand an opening allows for visual inspection of proper insertion of the male terminal.

This is not shown in the figures, but the present invention also proposes a motor comprising an electrical connector as described above. In case of the motor, the electrical connector housing may be integrally formed with a motor cover or a brush holder plate and therefore the female terminal is built into the connector portion of the motor cover or the brush holder plate. The electrical connector can also be arranged separately from the motor cover or the brush holder plate.

In summary, the present invention proposes providing a tilting restriction element, for maintaining the alignment of the female terminal so as to accept the insertion of the mating male terminal. This in turn avoids the female terminal to be damaged during the insertion of the mating male terminal because the terminal plates of the female terminal guides the mating male terminal from the opening of the electrical connector and this also keeps the female terminal movable inside the electrical connector cavity and can avoid the friction oxidation.

What is claimed is:

1. An electrical connector characterized by comprising:

a female terminal comprising:

a terminal base body;

one or more pairs of terminal plates facing each other, protruding in an insertion direction from the edge of the terminal base body, for receiving and connecting to a mating male terminal and the one or more pairs of terminal plates facing each other being adapted to form at least one recess for receiving the mating male terminal and to provide a clamping compressive force against the mating male terminal; and one or more tilting restriction elements arranged laterally with respect to the female terminal and protruding in the insertion direction from the edge of terminal base body and being arranged to have a width in parallel to the direction that the pair of terminal plates is facing each other, a connector cavity for building the female terminal in, wherein the female terminal is arranged within the connector cavity; and an opening of the electrical connector for inserting a mating male terminal for connecting the mating male terminal with the female terminal, wherein the connector cavity includes one or more contacting portions, formed by laterally arranged protrusions on either side of the connector cavity in the direction of said clamping compressive force or the direction that the pair of terminal plates is facing each other, protruding in both directions perpendicular to said insertion direction from said connector cavity so as to be arranged in a position corresponding to the one or more tilting restriction element(s) and contacting the tilting restriction element(s) when the female terminal tilts inside the connector cavity.

2. The electrical connector according to claim 1 comprising two pairs of terminal plates facing each other.

3. The electrical connector according to claim 1, wherein the terminal plates have terminal ends at their ends opposite to the terminal base body, wherein the gap between the terminal plates facing each other becomes bigger moving from the point that receives the mating male terminal towards the terminal ends so that a part of the terminal end remains invisible in view from the opening even when the tilting restriction elements contact either contacting portion.

4. The electrical connector according to claim 1, wherein the tilting restriction element is expanding outwardly.

5. The electrical connector according to claim 1, wherein the at least one tilting restriction member is substantially T-shaped, with a first width at the terminal base body side and a second width at the end side opposite to the terminal base body, the second width being larger than the first width.

6. The electrical connector according to claim 5, wherein the second width is less or equal to a width of the terminal base body.

7. The electrical connector according to claim 5, wherein the tilting restriction element comprises two tilting restriction members, protruding in the insertion direction from the edge of terminal base body, and the two tilting restriction members being laterally provided.

8. A motor comprising the electrical connector according to claim 1.

9. The electrical connection according to claim 1, wherein the at least one tilting restriction element is shorter in the insertion direction than the terminal plates, in particular the tilting restriction element is arranged below a top wall portion protruding inwardly from lateral edges of the connector cavity at the opening for inserting the mating male terminal or defining an edge thereof.

* * * * *